United States Patent [19]

Schaefer et al.

[11] Patent Number: 4,631,203

[45] Date of Patent: Dec. 23, 1986

[54] LATENT IMAGING AND DEVELOPER SYSTEM

[76] Inventors: Rolf Schaefer, Im Brueggli 12, CH-4422 Arisdorf, Switzerland; Haywood A. Walker, Jr., Box 432 D, Rte. 1, Liberty, Mo. 64068

[21] Appl. No.: 720,759

[22] Filed: Apr. 8, 1985

[51] Int. Cl.[4] ..... B41M 5/12

[52] U.S. Cl. ..... 427/145; 106/21; 427/150; 558/1; 434/328

[58] Field of Search ..... 427/145, 150; 106/21; 434/328; 260/502.6, 453.1, 453.2

[56] References Cited

U.S. PATENT DOCUMENTS

| | | | |
|---|---|---|---|
| 3,349,408 | 8/1965 | Gillen | 427/145 |
| 3,363,338 | 12/1965 | Skinner | 427/145 |
| 3,451,143 | 8/1966 | Thomas | 427/145 |
| 3,505,366 | 4/1970 | Greco et al. | 260/502.6 |
| 3,632,364 | 9/1968 | Thomas | 427/145 |
| 3,788,863 | 9/1968 | Scheuer | 427/145 |
| 3,823,022 | 7/1974 | Thomas | 427/145 |
| 4,051,283 | 11/1977 | Thomas | 428/29 |
| 4,303,719 | 12/1981 | Vassiliades | 427/150 |
| 4,455,262 | 6/1984 | Detienne | 260/502.6 |
| 4,461,496 | 7/1984 | Ludwig | 106/21 |

FOREIGN PATENT DOCUMENTS 415535 5/1933 United Kingdom .

*Primary Examiner*—John D. Smith
*Assistant Examiner*—Janyce A. Bell
*Attorney, Agent, or Firm*—Schmidt, Johnson, Hovey & Williams

[57] ABSTRACT

A sharp imaging, non-smearing system for latent imaging and subsequent visual development of printed text or the like is provided which can be used on a variety of substrates (e.g., paper, metal, cloth, synthetic resins) and is extremely stable and easy to use. The system involves first imaging a substrate with an invisible ink containing a dissociable transition metal salt such as $CuSO_4$, with subsequent application of a liquid developer containing a solubilized color precursor such as thiooxalic amide which complexes with dissociated transition metal ion to give a sharp, virtually instantaneously developing, long lasting color. Depending upon the metal salt selected, different colors can be obtained upon development. The system of the invention can be used in a variety of contexts, such as in self-testing materials or novelty items.

23 Claims, No Drawings

LATENT IMAGING AND DEVELOPER SYSTEM

BACKGROUND OF THE INVENTION

1. Field of the Invention

The present invention is concerned with a greatly improved system for latent or invisible imaging of printed material onto a variety of substrates, with subsequent development of the latent image by application of a corresponding developing fluid. More particularly, it is concerned with such a latent imaging system, and a novel developer forming a part thereof, which makes use of a dissociable transition metal salt in the imaging ink, and a color precursor in the developer fluid which includes an oxalic acid derivative capable of complexing with the transition metal ion to give a sharp, long lasting, non-smearing color.

2. Description of the Prior Art

Invisible or sympathetic inks, or more commonly "secret writing", have been a staple of romantic liasons and espionage activities for many centuries. Indeed, reports of such "secret writing" date back to antiquity.

However, most modern day sympathetic ink systems of commercial importance are designed for less adventuresome environments of use, for example in self-testing educational booklets. In such uses, a student may be provided with a multiple choice answer sheet, with the correct answer being indicated by appropriate latent image indicia. In selecting an answer, the student marks one of the multiple choice possibilities with a developer substance; if his selection is correct, the latent indicia will immediately reveal the student's correct choice and hence his progress. Other uses include certification testing, personnel selection and screening tests, novelty items such as games and toys, children's books designed for educational and/or entertainment purposes, securing of documents, prize verification and promotional items.

Systems of the type described typically involve application of a latent image by means of a normally invisible printing ink. Thereafter, the developer substance is applied over the invisible image and a color-forming chemical reaction occurs to "develop" the image and render the same visible. For example, U.S. Pat. No. 3,632,364 describes a latent imaging system wherein the invisible ink includes a soluble copper salt such as copper sulfate, while the developer includes a soluble iodide. In practice, the invisible ink is printed onto conventional paper, and is invisible to the naked eye. When the developer is applied, the iodide is oxidized by the copper ion present in the printed image to release iodine; the iodine in turn reacts with the starch in the paper to form a color. Other patents describing various latent imaging systems include U.S. Pat. Nos. 3,823,022, 4,051,283, 3,788,863, 3,451,143, 3,363,338 and 3,349,408. Other references include British Pat. No. 415,535 and an article entitled "Tintas Simpaticas" by P. L. De Araujo Feio, *Revista Da Sociedade Brasileira de Quimica,* Boletin Cientifico, Vol XIV, Janeiro-Marco de 1945, N. 1, Rio de Janeiro, Brazil. While certain latent imaging systems of the type described have found commercial application in, e.g., education selftesting materials and the like, they are typically plagued by a number of deficiencies. For example, the copper sulfate/soluble iodide system tends to develop an unstable color which will disappear under prolonged heating or ultraviolet light conditions. Moreover, in many instances the visual image lacks sharpness and clarity, and the color can smear if repeated applications of the developing fluid are made. Furthermore, use of this type of system is in practice generally limited to paper substrates, because of the necessity of having starch present as a part of the overall reaction. Thus, such a system is much more difficult to employ in the case of non-paper substrates such as metal or synthetic resin bodies.

SUMMARY OF THE INVENTION

The present invention overcomes the problems noted above and provides a greatly improved method of imaging a substrate with a concealed image, followed by subsequent development of the image to render the same visible. The system of the present invention provides an extremely stable and long lasting sharp color image upon development, and moreover can be used with virtually any type of substrate.

Broadly speaking, the method of the present invention involves imaging a substrate with a printing material having therein a dissociable salt of a transition metal, with the printing material being characterized by the properties of being invisible to the naked eye when applied to the substrate, and remaining invisible to the naked eye on the substrate under normal ambient conditions for a period of at least about three months, and more preferably at least about six months. Visual development of the concealed image is accomplished by applying thereto a liquid developer substance. The developer comprises a color precursor compound selected from the group consisting of dithiooxalic acid and compounds of the formula $$X_1{=}\overset{\overset{Y_1}{|}}{C}{-}\overset{\overset{Y_2}{|}}{C}{=}X_2 \qquad \text{I.}$$

wherein $X_1$ and $X_2$ are respectively taken from the group consisting of NH and N—$R_1$, $R_1$ being an alkyl group of from 1 to 4 carbon atoms, inclusive, and $Y_1$ and $Y_2$ are respectively taken from the group consisting of SH and S—$R_2$, $R_2$ being an alkyl group having from 1 to 4 carbon atoms, inclusive. The precursor compound as above defined is dispersed in a carrier for dissociating the salt of the printing material into dissociated transition metal cations and salt-forming anions, and for maintaining the color precursor compound in a solubilized state in the presence of the dissociated salt. This permits a color reaction to take place between the dissociated transition metal cation and the solubilized color precursor compound. Specifically, these components react to form an insoluble, highly stable dye compound on the substrate.

A wide variety of transition metal ion salts can be used to good effect in the invention, provided that they have the stability requisites noted above. That is to say, certain transition metal salts may be subject to relatively rapid oxidation on a substrate, and should therefore be avoided. In practice, it has been found that the transition metals from Period IV of the Periodic Table are preferred, with the most preferred salts being those of copper, nickel, cobalt and zinc. The corresponding salt-forming anions for the metals can likewise be selected from a wide variety of choices, such as for example the halogens, sulfates and organic ion moieties. Typical organic salt-forming anions would include those such as the acetates, propionates and sulfonates.

The transition metal salts forming a part of the imaging or printing material are typically suspended in a carrier. Particularly good results have been obtained with a carrier comprising a major proportion of glycerine, together with a minor amount of commercially available surfactant. The transition metal salt forms a relatively small proportion of the overall printing material, i.e., usually the printing material contains only up to about eight percent by weight of transition metal salt, or from 1 to 3.5% by weight of transition metal, calculated as the cationic form thereof.

As indicated previously, a virtually unlimited number of substrates can be used in the context of the invention, so long as the printing material can be applied thereto and no adverse reactions occur between the transition metal salt of the printing material and the substrate. Thus, substrates selected from the group consisting of paper, metals, wood, cloth and synthetic resins can normally be used in the invention.

The developer of the present invention broadly includes a color precursor compound of the type defined above, together with a carrier. Most preferably, the carrier includes water (assuming that the transition metal salt of the printing material is in fact dissociable in water), together with an organic solvent or surfactant for solubilizing the color precursor. Water is advantageously present in the carrier at a level of from about 55 to 80% by weight. In preferred forms of the invention use can be made of a variety of organic solvents such as the alcohols, dioxane, formamideand N-methyl-2-pyrrolidone; the only real requirement is that the solvent be capable of maintaining the color precursor compound in a solubilized state, so as to permit the reaction thereof with transition metal cation. When use is made of such organic solvents, the overall developer would typically contain from about 20 to 80% solvent, and more preferably from about 45 to 55% solvent.

In other cases, the organic solvent can be omitted when use can be made of an appropriate surfactant. In such instances, the surfactants dissolve the color precursor compound by forming micromicelles which are effectively in solution. Again, a variety of surfactants can be employed so long as the necessary functional properties are present. A polyoxypropylene-polyoxyethylene block copolymer surfactant has been used to good effect in the invention. In the case of surfactants, such should be present in the overall developer at a level of from about 5 to 35% by weight, and more preferably at a level of about 20 to 25% by weight.

The color precursor compounds of the invention can broadly be classed as derivatives of oxalic acid. One such derivative, dithiooxalic acid, can be used in the invention but generally gives a relatively faint color. Accordingly, it is more preferred to make use of one of the thiooxalic amides or alkyl amides defined by the structural formula I set forth above. The most preferred color precursor compound is the thiooxalic amide compound

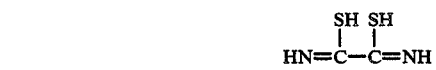

II.

In normal practice, the precursor should be present at a level of from 50 to 100% of saturation in the carrier being used.

DESCRIPTION OF THE PREFERRED EMBODIMENTS

The most preferred latent imaging printing material, for purposes of printing onto paper substrates, has 7–8% by weight of copper sulfate salt dispersed in a carrier comprising glycerin having dissolved therein 0.06 grams per liter of sodium diethylsulfosuccinate surfactant. Use may be made of lithographic, letterpress, letterset, flexographic, silk screen and rotogravure equipment in the context of the invention. The starting materials are simply mixed together to form a desirable flowable printing material. This formula provides a printing material having sufficient solubility or dispersibility of the metal salt, and appropriate viscosity characteristics for use in high speed sheet or web fed printing press equipment. Moreover, the material leaves no substantial residue on the imprinted substrate and slowly evaporates over time. Finally, the printing material is entirely invisible to the naked eye and is extremely stable over very long periods of time.

While the foregoing composition is most preferred, those skilled in the art will recognize that numerous variations in the transitin metal salt employed, as well as in the carrier, can be made. This is particularly the case when it is desired to imprint on different substrates such as solid metallic or synthetic resin objects. In such instances routine experimentation may be required to optimize the printing material.

One developer substance comprises a mixture of water and surfactant, together with the thiooxalic amide of formula II. Specifically, a mixture of 75% by weight water and 25% by weight of Pluronic L64 surfactant is employed as the carrier for the color precursor of the developer. Such is made by simply mixing together the two components and stirring until homogeneous. The Pluronic L64 surfactant is a polyoxypropylene-polyoxyethylene block copolymer nonionic surfactant sold by the BASF Wyandotte Corporation of Parsippany, New Jersey. This surfactant is fully described in a technical bulletin entitled "Pluronic/ L64 block copolymer surfactant" distributed by the seller, and such bulletin is hereby incorporated by reference herein. Briefly however, the preferred surfactant is in the form of a liquid, has an average molecular weight of 2900, a specific gravity (25°/25° C.) of 1.05, a viscosity of 850 cps at 25° C., a pour point of 16° C., a cloud point (1% aqueous) of 61° C., a foam height (0.1% aqueous) of greater than 600 millimeters at 400 milliliters/minutes at 49° C., a surface tension (0.1% aqueous) of 43.2 dynes/centimeter at 25° C., a HLB of 15.0, a solubility in water at 25° C. of greater than 10% and a wetting, Draves sink time (3-gm. hook, 0.1 aqueous at 25° C.) of 653 seconds.

After the carrier for the developer is prepared as described, an excess (e.g., about 0.5% by weight) of the thiooxalic amide of formula II is added with stirring for 30–60 minutes at ambient temperature. At this point the mixture is centrifuged using a standard laboratory device for 5 minutes at 5000 revolutions per minute. The liquid fraction is then decanted as the developer.

In other specific developer formulations, use can be made of 1:1 (v/v) mixtures of water and ethanol or water and isopropynol, with the color precursor being added to excess of saturation, followed by mixing, centrifuging and decanting steps described to obtain the developer fluid.

The most preferred developer for use in developing latent images imprinted on paper substrates comprises a carrier made up of 50% by volume water and 50% by volume N-methyl-2-pyrrolidone, which are simply mixed together at ambient conditions. After the carrier is prepared, 2% by weight of the thiooxalic amide of formula II is added, followed by the mixing centrifuging and decanting steps described above.

When the most preferred transition metal salt, copper sulfate, is employed in the printing material, the resultant color using the described developer is black. However, if use is made of other transition metal salts, different colors will result. Thus, nickel salts will generally yield blue final colors upon developing, whereas cobalt salts will give yellow-brown final colors. In all cases though, insoluble complexes are formed between the transition metal cations and the color precursors. Such complexes are believed to involve bridging of the sulfur atoms in the precursor by the transition metal ion, to form acyclic dye species.

If desired, the developer may be supplemented with a dye or pigment apart from the precursor. Such may be useful for visibly marking the region of the substrate to which the developer has been applied, even if that region did not contain any latent image.

As indicated above, the present invention can be used in a variety of contexts, such as in the printing industry and in novelty items. In the latter case, a novelty pen set can be prepared with a first imaging pen containing a printing material in accordance with the invention, and a second developer pen containing the developer fluid. In use, a substrate is imaged with the first pen, and later developed with the second pen.

Those skilled in the art will readily appreciate that while certain specific printing material and developer formulations have been described, numerous variations can be made without departing from the spirit and scope of the present invention. It is, of course, intended to cover all such appropriate alternatives and variations.

We claim:

1. A method of imaging a substrate with a concealed image, and subsequently developing the concealed image to render the same visible, said method comprising the steps of:

imaging said substrate with a printing material having therein a dissociable salt of a transition metal, said material being characterized by the properties of being invisible to the naked eye when applied to said substrate, and remaining invisible to the naked eye on the substrate under normal ambient conditions for a period of at least about three months;

thereafter visually developing said invisible image by applying thereto a liquid developer substance, said developer comprising a color precursor compound selected from the group consisting of dithiooxalic acid and compounds of the formula $$X_1{=}\overset{\overset{Y_1}{|}}{C}{-}\overset{\overset{Y_2}{|}}{C}{=}X_2$$

wherein $X_1$ and $X_2$ are respectively taken from the group consisting of NH and N—$R_1$, $R_1$ being an alkyl group of from 1 to 4 carbon atoms, inclusive, and $Y_1$ and $Y_2$ are respectively taken from the group consisting of SH and S—$R_2$, $R_2$ being an alkyl group having from 1 to 4 carbon atoms, inclusive, said precursor compound being dispersed in a carrier for dissociating said salt into dissociated transition metal cation and salt-forming anions, and for maintaining said color precursor compound in a solubilized state in the presence of the dissociated salt for permitting a color reaction to take place between said dissociated transition metal cation and said solubilized color precursor compound.

2. The method of claim 1, said transition metal being a Period IV transition metal.

3. The method of claim 2, said metal being selected from the group consisting of copper, nickel, cobalt and zinc.

4. The method of claim 1, said salt being selected from the group consisting of the halogen, sulfate and organic salts of the transition metals.

5. The method of claim 1, said printing material comprising up to about 8% by weight of said salt.

6. The method of claim 1, said printing material comprising from about 1 to 3.5% by weight of said transitio metal, calculated as the cationic form thereof.

7. The method of claim 1, said substrate being selected from the group consisting of paper, metals, wood, cloth and synthetic resins.

8. The method of claim 1, said printing material including a major proportion of glycerin.

9. The method of claim 1, said developer carrier including water.

10. The method of claim 9, said water being present at a level of from about 55 to 80% by weight.

11. The method of claim 1, said carrier including an organic solvent for said color precursor compound.

12. The method of claim 1, said carrier comprising water and a surfactant.

13. The method of claim 1, said color precursor compound being $$HN{=}\overset{\overset{SH}{|}}{C}{-}\overset{\overset{SH}{|}}{C}{=}NH$$

14. The method of claim 13, said precursor compound being present at a level of from about 50 to 100% of the saturation level thereof in said carrier.

15. The method of claim 1, said developer including a dye or pigment therein for visibly marking said substrate apart from said development of said invisible image.

16. A liquid developer for use in developing an invisible image on a substrate, said image including therein a dissociable salt of a transition metal, said developer comprising a color precursor compound selected from the group consisting of dithiooxalic acid and compounds of the formula.

$$X_1{=}\overset{\overset{Y_1}{|}}{C}{-}\overset{\overset{Y_2}{|}}{C}{=}X_2$$

wherein $X_1$ and $X_2$ are respectively taken from the group consisting of NH and N—$R_1$, $R_1$ being an alkyl group of from 1 to 4 carbon atoms, inclusive, and $Y_1$ and $Y_2$ are respectively taken from the group consisting of SH and S—$R_2$, $R_2$ being an alkyl group having from 1 to 4 carbon atoms, inclusive, said precursor compound being dispersed in a carrier comprising water and a surfactant for dissociating said salt into dissociated transition metal cation and salt-forming anion, and for maintaining said color precursor compound in a solubilized state in the presence of the dissociated salt for permitting a color reaction to take place between said dissociated transition metal ion and said solubilized color precursor compound.

17. The developer of claim 16, said salt being dissociable in water, said carrier comprising water.

18. The developer of claim 16, said carrier including an organic solvent for said color precursor.

19. The developer of claim 16, said color precursor compound being

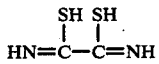

20. The developer of claim 16, including a quantity of N-methyl-2-pyrrolidone.

21. A liquid developer for use in developing an invisible image on a substrate, said image including therein a dissociable salt of a transition metal, said developer comprising a color precursor compound of the formula

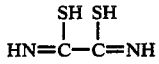

said precursor compound being dispersed in a carrier for dissociating said salt into dissociated transition metal cation and salt-forming anion, and for maintaining said color precursor compound in a solubilized state in the presence of the dissociated salt for permitting a color reaction to take place between said dissociated transition metal ion and said solubilized color precursor compound.

22. A liquid developer for use in developing an invisible image on a substrate, said image including therein a dissociable salt of a transition metal, said developer comprising a color precursor compound selected from the group consisting of dithiooxalic acid and compounds of the formula

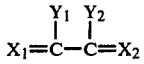

wherein $X_1$ and $X_2$ are respectively taken from the group consisting of NH and N—$R_1$, $R_1$ being an alkyl group of from 1 to 4 carbon atoms, inclusive, and $Y_1$ and $Y_2$ are respectively taken from the group consisting of SH and S—$R_2$, $R_2$ being an alkyl group having from 1 to 4 carbon atoms, inclusive, said precursor compound being dispersed in a carrier for dissociating said salt into dissociated transition metal cation and salt-forming anion, and for maintaining said color precursor compound in a solubilized state in the presence of the dissociated salt for permitting a color reaction to take place between said dissociated transition metal ion and said solubilized color precursor compound, said developer further including a quantity of N-methyl-2-pyrrolidone.

23. A liquid developer for use in developing an invisible image on a substrate, said image including therein a dissociable salt of a transition metal, said developer comprising a color precursor compound selected from the group consisting of compounds of the formula

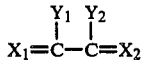

wherein $X_1$ and $X_2$ are respectively taken from the group consisting of NH and N—$R_1$, $R_1$ being an alkyl group of from 1 to 4 carbon atoms, inclusive, and $Y_1$ and $Y_2$ are respectively taken from the group consisting of SH and S—$R_2$, $R_2$ being an alkyl group having from 1 to 4 carbon atoms, inclusive, said precursor compound being dispersed in a carrier for dissociating said salt into dissociated transition metal cation and salt-forming anion, and for maintaining said color precursor compound in a solubilized state in the presence of the dissociated salt for permitting a color reaction to take place between said dissociated transition metal ion and said solubilized color precursor compound.

* * * * *